US007664635B2

(12) United States Patent
Osmanovic et al.

(10) Patent No.: US 7,664,635 B2
(45) Date of Patent: Feb. 16, 2010

(54) ADAPTIVE VOICE DETECTION METHOD AND SYSTEM

(75) Inventors: Nermin Osmanovic, Bellevue, WA (US); Erich Velandia, Miami, FL (US)

(73) Assignee: Gables Engineering, Inc.

( * ) Notice: Subject to any disclaimer, the term of this patent is extended or adjusted under 35 U.S.C. 154(b) by 799 days.

(21) Appl. No.: 11/221,425

(22) Filed: Sep. 8, 2005

(65) Prior Publication Data

US 2007/0055499 A1 Mar. 8, 2007

(51) Int. Cl.
*G10L 19/14* (2006.01)

(52) U.S. Cl. ..... 704/211

(58) Field of Classification Search ..... 704/211
See application file for complete search history.

(56) References Cited

U.S. PATENT DOCUMENTS 5,012,519 A * 4/1991 Adlersberg et al. ..... 704/226
5,134,658 A * 7/1992 Chen et al. ..... 704/233
5,369,711 A * 11/1994 Williamson, III ..... 381/104
5,661,765 A * 8/1997 Ishizu ..... 375/376
5,774,557 A * 6/1998 Slater ..... 381/56
6,066,243 A * 5/2000 Anderson et al. ..... 422/82.01

* cited by examiner

*Primary Examiner*—Susan McFadden
(74) *Attorney, Agent, or Firm*—Michael J. Buchenhorner

(57) ABSTRACT

A system for detecting a voice signal includes: a first integrator for receiving an input signal and for providing a first integrator output signal, wherein the first integrator includes a first attack time; a second integrator for receiving the input signal and for providing a second integrator output signal, the second integrator including a second attack time that is substantially slower than the first attack time; and a comparator configured for receiving the first and second integrator output signals and for providing a comparator output signal indicating detection of a voice signal when the first integrator output signal exceeds the second integrator output signal by at least a threshold amount.

15 Claims, 3 Drawing Sheets

ADAPTIVE VOICE DETECTION METHOD AND SYSTEM

FIELD OF THE INVENTION

The invention broadly relates to the field of electronic devices, and more particularly relates to the field of voice detection devices.

BACKGROUND OF THE INVENTION

Voice-detection devices such as voice-activated (VOX) switches are known means to activate and deactivate microphones. However, it is difficult to set a threshold to activate such switches only when a human voice is received. This difficulty arises because of the similarities between human speech and other sounds received by the microphone. In some environments, such as an aircraft cockpit it is important to activate a microphone only in response to a human voice and to deactivate only in the absence of a human voice. However, in many noisy environments it is difficult to distinguish between voice and background noise. Therefore, there is a need for an adaptive voice activated switch (AVOX) that overcomes the aforementioned shortcomings.

SUMMARY OF THE INVENTION

Briefly, according to an embodiment of the invention, a system for detecting a voice signal in varying noise includes: a first integrator for receiving an input signal and for providing a first integrator output signal, wherein the first integrator includes a first attack time; a second integrator for receiving the input signal and for providing a second integrator output signal, the second integrator including a second attack time that is substantially slower than the first attack time; and a comparator configured for receiving the first and second integrator output signals and for providing a comparator output signal indicating detection of a voice signal when the first integrator output signal exceeds the second integrator output signal by at least a threshold amount.

DETAILED DESCRIPTION

A distinguishing characteristic of human speech is its spectral energy change over time. This feature can be used to design a voice activity detector that operates in real time. However, different people have loud or soft voices, and this difference should be taken into account for precise voice detection. Also, gender and age of the speaker are of great importance for the energy distribution across the spectral bands.

Human voice recording sessions with various subjects (male, female, young, old) performed using several sentences that resemble real life situation provide information useful for understanding voice characteristics such that a switch will only change state when human voice is received. According to an embodiment of the invention we set a threshold for activating a microphone when a human voice is detected in a standard aircraft audio equipment environment. The background noise can include erroneous sounds such as coughing, eating and other sounds. Two helpful operations for speech analysis include power density spectrum and spectrogram displays.

Each uttered word produces unique spectral and temporal characteristics that can be used for the speech recognition operation. The great ability of the human brain to unconsciously recognize pronounced phonemes while connecting them into words and sentences is still unsurpassed by computer systems. However, digitized audio can be analyzed by a computer to determine the presence of speech.

Figure 1:
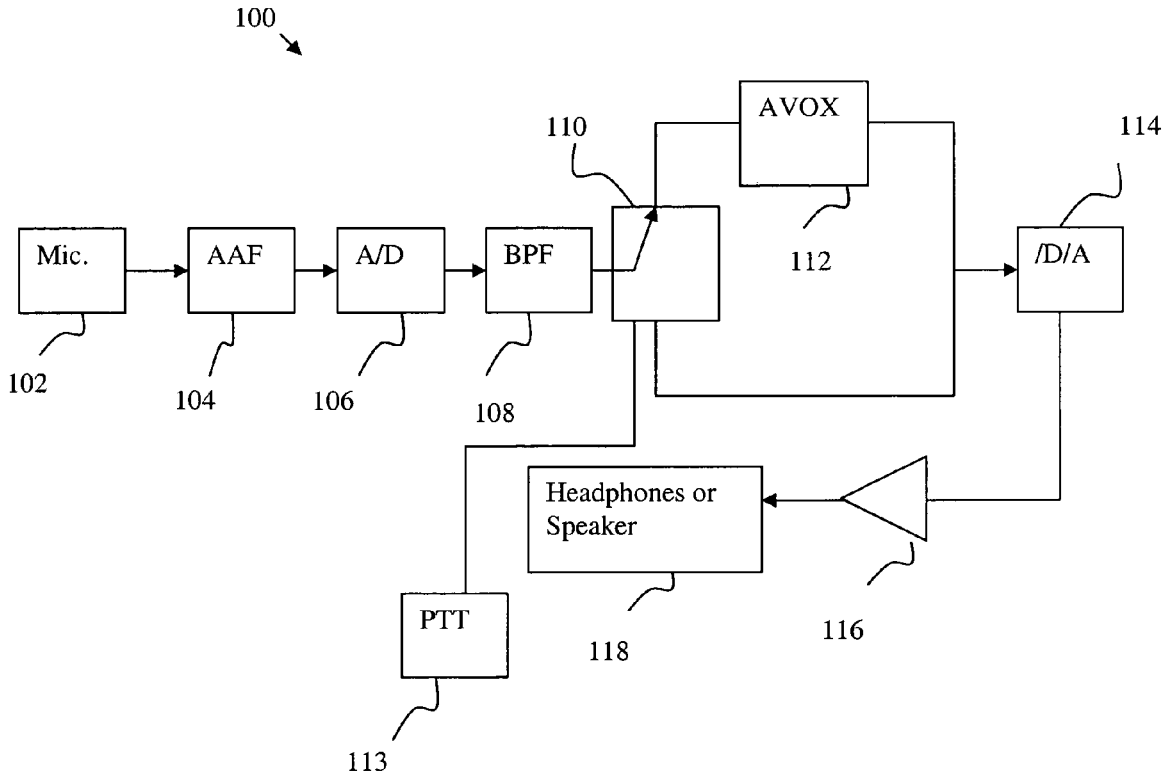
FIG. 1 is a block diagram of an AVOX system according to an embodiment of the invention.

Referring to FIG. 1, there is shown a high-level block diagram of a voice detection system 100 according to an embodiment of the invention. In this embodiment the detection of voice at the input microphone 102 is used to trigger the processing of the input to the microphone 102 for presentation at the output headphones or speaker 118.

The output of the microphone 102 is provided to an anti-aliasing filter 104 which removes frequency components that are beyond the range of the analog-to-digital converter 106. The analog-to-digital converter 106 converts the input audio signal into a digital audio signal for processing by the system 100. The digital signal is then provided to a bandpass filter 108 that passes only a selected band (e.g., a frequency band 300 Hz to 6,000 Hz) to a switch 110. The switch 110 has two positions. In the position shown in FIG. 1 the system 100 is in an AVOX mode. When the switch is in the other position, it is responsive to a user pressing a push-to-talk (PTT) switch 113, this is a PTT mode wherein the input signal is provided at the output when the PTT is pressed. In either mode the processed digital signal is converted to analog form by a digital-to-analog converter 114, amplified by an amplifier 116, and provided at the output 118.

Figure 2:
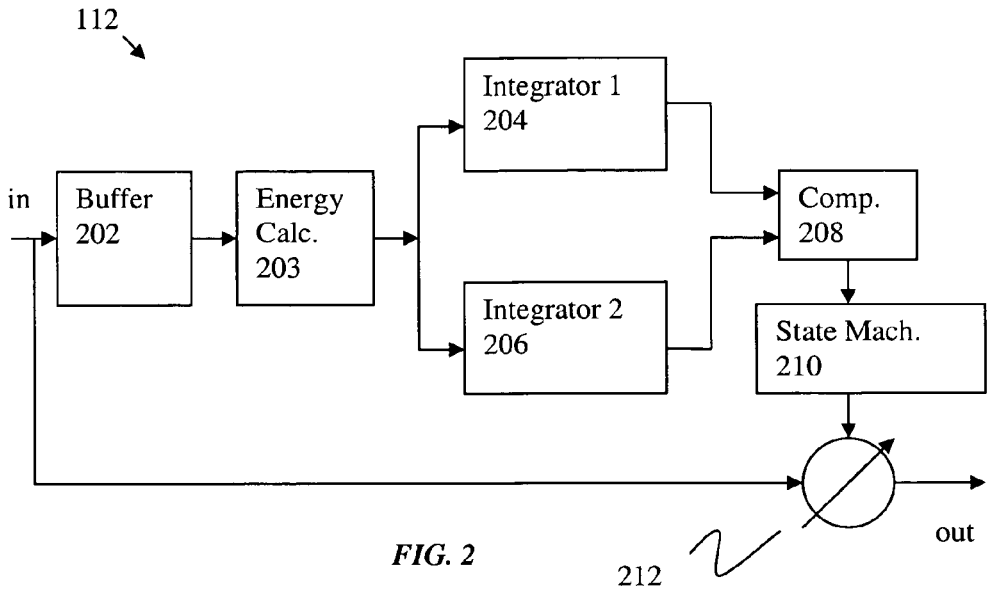
FIG. 2 shows block diagram of a threshold setting mechanism system according to the embodiment of the invention.

Referring to FIG. 2, there is shown a high-level block diagram of the AVOX 112, according to this embodiment of the invention. A buffer 202 is used for storing the output of the bandpass filter 108 so that it can be processed for detection of a voice signal that is appropriate for passing the received voice signal to other circuitry such as the headphones or speaker 118. For the specific purposes of the AVOX 112 we are not concerned with speech recognition but with energy threshold activation. According to this embodiment, an energy calculator 203 in the AVOX 112 scans the audio input stored in the buffer 202 for energy change across spectral bands. The duration of the sampling window (buffer 202 used by the energy calculator 203) is such that a measured sample will reflect the faster-changing level of the voice energy but not the slower-rising level of the ambient noise level. This avoids opening the channel in response to a rise in ambient noise. Calculated energy is normalized to more efficiently control the energy magnitude range as used on an AVOX control. A logarithmic base 10 calculation is performed on the energy value for the better threshold activation resolution, or greater dynamic range of operational AVOX Parameters.

During a windowing operation, the energy of the signal may be calculated for each window of 80 samples (32 kHz sampling), by following the basic energy formula in the time domain:

$$E(f)=(y^2(n))$$

where E(f) is the calculated energy of the frame, and y(n) is the input signal. During this operation it is necessary to calculate the logarithmic scale of the energy for better detection, due to variations in the cabin noise. In this implementation, energy value is stored in a separate array that contains energy value for each window. This new array, when plotted, displays the energy curve, which graphically shows the times at which the algorithm should kick-in and transmit the voice on the input.

Next a test is done by setting all values in the current window to zero (0) if the value of the energy across the spectral bands is less than a certain threshold. This actively disables the audio channel if too little energy is present at the input.

A buffer window size of 80 samples is good because it contains enough information to correctly detect speech, yet demonstrates smooth and fast channel switching.

Figure 3:
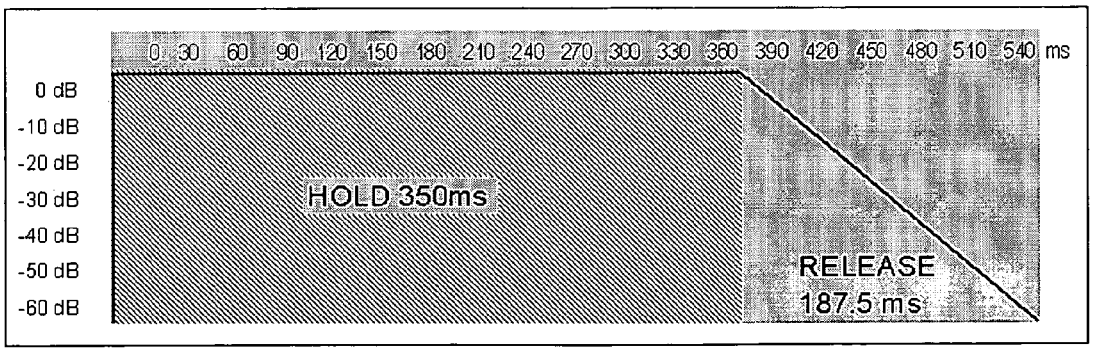
FIG. 3 shows the amplitude envelope of an AVOX activation mechanism according to the embodiment of the invention

The AVOX 112 comprises a first integrator (or filter) 204 and a second integrator (or filter) 206. The first and second integrators each receive the energy calculated for each frame of the buffered signal. The time constant is a measure of how fast an integrator reflects at its output a change in the input. The first integrator 204 has a fast time constant and the second integrator 206 has a substantially slower time constant. Therefore, the first integrator 204 picks up the fast changes associated with human voice (in a frame) earlier than the second (slower) integrator does. A comparator 208 receives the outputs of the two integrators. If both integrators are receiving ambient noise then the output of both will be the same in the steady state and the comparator output provides an indication of no difference. When a voice is received at the input, the first integrator 204 will provide an output reflecting receipt of the voice before the second integrator does. When the output of the first integrator 204 reaches a threshold level (e.g., 15 dB) above the level of the output of the second integrator 206, the comparator 208 provides a signal indicating detection of the difference (and that a voice has been detected). The comparator output is provided to a state machine 210 that controls a gate (e.g., a volume potentiometer) 212. The behavior of the volume potentiometer 212 is shown in FIG. 3. The state machine has three states. In a first state (attack) the gate 212 is opened by the state machine 210 as soon as speech is detected and thus quickly begins passing the input signal to the output. In the second state (hold) the transmission channel is automatically maintained while the voice signal is present at the input (i.e., it is automatically held open, for example, for 350 ms). In the third state the gate waits a release period (e.g., 187.5 ms) while it gradually attenuates the input signal until it is no longer audible at the output. The hold and release states occur even if the speech only lasted for a brief period, such as 10 ms. Thus, the gate 212 attenuates the input signal according to the state machine 210 such that its output is at a high (e.g., not attenuated) level from the time that a voice is detected (while the difference signal provided by the comparator 208) and remains at that level for some time plus the release delay (in this example 187.5 ms). The delay in the second integrator 206 reaching the level of the first integrator 204 can be used to provide the release delay so that the channel remains open during that delay. This release delay prevents the premature release of the channel so that no release takes place between syllables or during brief periods of low level energy that regularly occur during normal speech. Preferably, the first integrator 204 has a fast attack time and a fast release time and the second has a slower attack time but the same or substantially the same release time (e.g., it is pulled down by the first integrator).

Several parameters are necessary for good performance of the AVOX 112; these include a digital mixer for gate effect configured for best threshold value, including attack, release and hold times. In implementing the AVOX 112, attention should be placed on the quality of the performance, the speed of activation, and additional unwanted sound artifacts created by poor parameters settings. A fast attack time of approximately zero ms should provide good results, as well as release time of 5 ms. However, real life situations (sentences, speech) may require around 200 ms release time for quiet, almost non-audible transition between speech and non-speech segments.

The system 100 can be implemented with conventional hardware executing software according to an embodiment of the invention. Parameters such as buffer size, sample rate, and numeric values of the samples should be chosen to fit the specifications of the working audio hardware system to be used.

Referring to FIG. 3, we show the timing for holding the output of the gate 212 in a low attenuation mode (350 ms) and the release time (187.5 ms). This timing allows the voice to be passed to the output 118 and prevents the connection from being lost during natural pauses is speech such that no voice is lost.

Figure 4:
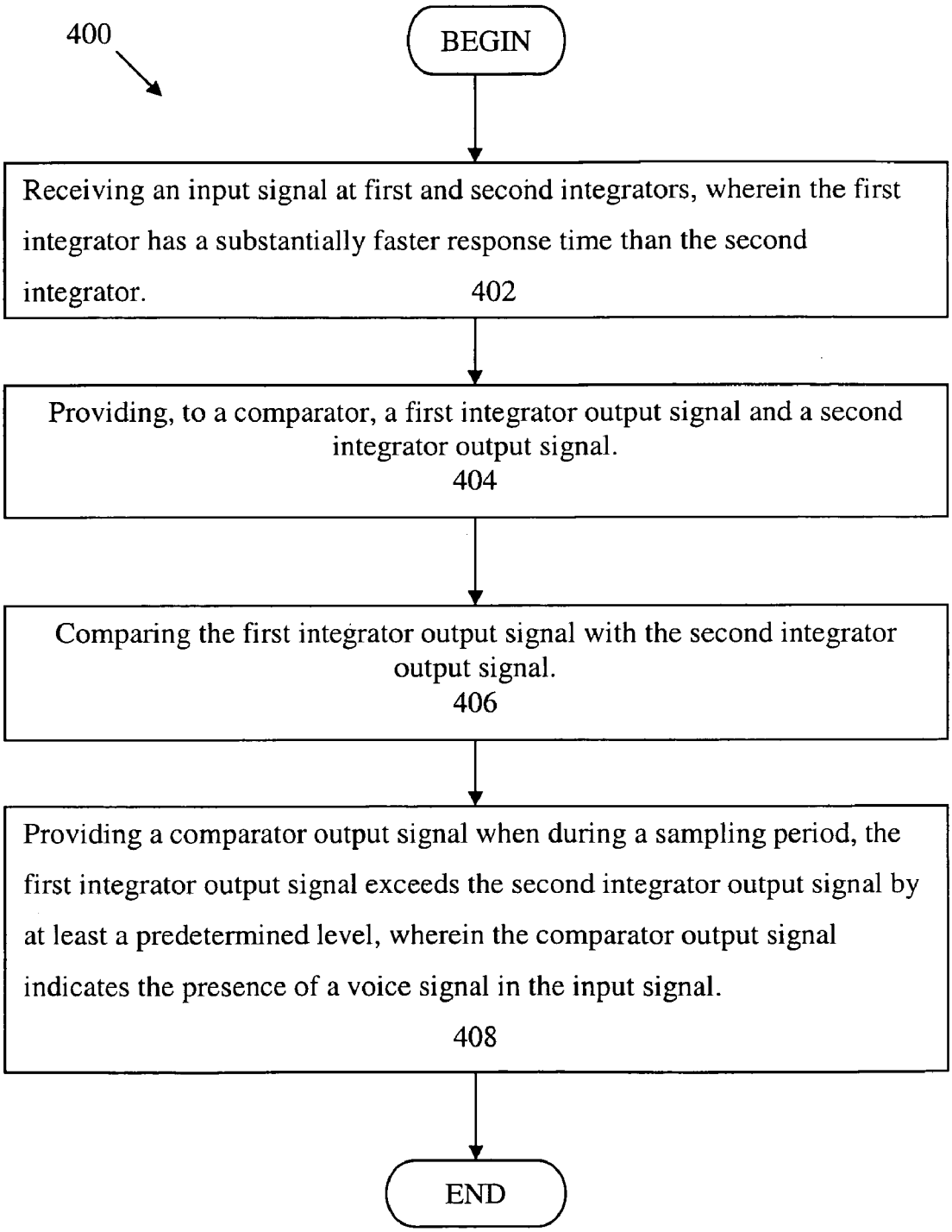
FIG. 4 is a flow chart illustrating a method according to the embodiment of the invention.

Referring to FIG. 4, a flowchart illustrates a method 400 for detecting voice signals according to this embodiment. In step 402 an input signal is received at first and second integrators. The first integrator has a substantially faster response time than the second integrator. Step 404 provides to a comparator, a first integrator output signal and a second integrator output signal. Step 406 compares the first integrator output signal with the second integrator output signal. Step 408 provides a comparator output signal when, during a sampling period, the first integrator output signal exceeds the second integrator output signal by at least a predetermined level. The comparator output signal indicates the presence of a voice signal in the input signal. This voice signal can be used to set an activation level for an AVOX switch such that the AVOX switch passes the audio signal only when the voice signal is detected.

Therefore, while there has been described what is presently considered to be the preferred embodiment, those skilled in the art will understand that other modifications can be made within the spirit of the invention.

What is claimed is:

1. A system for detecting a voice signal, said system comprising:

a first integrator for receiving an input signal and for providing a first integrator output signal, wherein the first integrator comprises a first attack time;

a second integrator, coupled in parallel with the first integrator, for receiving the input signal and for providing a second integrator output signal, wherein the second integrator comprises a second attack time that is slower than the first attack time; and a comparator for receiving the first and second integrator output signals and for providing a comparator output signal indicating detection of the voice signal when the first integrator output signal exceeds the second integrator output signal by at least a threshold amount.

2. The system of claim 1, further comprising a gate coupled to the comparator for providing an output comprising the voice signal, in response to receiving the output signal indicating the detection of the voice signal.

3. The system of claim 1, further comprising a buffer for storing samples of the input signal.

4. The system of claim 1, wherein the threshold amount is a 15 Decibels difference between the first and second integrator output signals.

5. The system of claim 2 further comprising a state machine disposed between the comparator and the gate, wherein the state machine comprises an input, to receive the comparator output signal, and an output for setting a release delay such that the gate continues to pass the input signal to the output of the gate during a hold and release delay after the first integrator output signal drops below the threshold level.

6. The system of claim 1 further comprising an analog-to-digital converter for receiving the input signal and providing a digitized version of input signal to the first and second integrators.

7. The system of claim 1 further comprising a speaker coupled to the gate to present an audio signal.

8. The system of claim 3 further comprising an energy calculator disposed between the buffer and the integrators, wherein the energy calculator is for sampling at least a part of the signal stored in the buffer and to provide an energy representation of the signal stored in the buffer to the integrators.

9. A method for detecting voice signals, the method comprising:

coupling a first integrator in parallel with a second integrator;

receiving an input signal at the first and second integrators, wherein the first integrator has a faster response time than the second integrator;

providing, to a comparator, a first integrator output signal and a second integrator output signal;

comparing the first integrator output signal with the second integrator output signal, and providing a comparator output signal when, during a sampling period, the first integrator output signal exceeds the second integrator output signal by at least a predetermined level, wherein the comparator output signal indicates the presence of a voice signal in the input signal.

10. The method of claim 9 further comprising storing samples of the input signal.

11. The method of claim 10 further comprising storing a window of samples of the input signal for analysis.

12. The method of claim 9 further comprising coupling the input signal to an output in response to detecting a level of the first output signal that exceeds the level of the second signal by a threshold amount.

13. The method of claim 9 further comprising activating a device responsive to the presence of a voice signal in the input signal.

14. The method of claim 13, further comprising deactivating the device in response to detecting that the voice signal is no longer present at the output and after a release delay.

15. A voice activated switch comprising:

a first integrator for receiving an input signal and for providing a first integrator output signal, wherein the first integrator comprises a first attack time;

a second integrator, coupled in parallel with the first integrator, for receiving the input signal and for providing a second integrator output signal, the second integrator comprises a second attack time that is slower than the first attack time;

a comparator for receiving the first and second integrator output signals and for providing a comparator output signal indicating detection of a voice signal when the first integrator output signal exceeds the second integrator output signal by at least a threshold amount; and a gate coupled to the comparator and for providing an output comprising an output signal comprising the voice signal, in response to receiving the signal indicating detection of the voice signal.

* * * * *